US010525499B2

(12) United States Patent
Koganehira et al.

(10) Patent No.: US 10,525,499 B2
(45) Date of Patent: Jan. 7, 2020

(54) LIQUID EJECTION SYSTEM AND COMPUTER PROGRAM

(71) Applicant: SEIKO EPSON CORPORATION, Tokyo (JP)

(72) Inventors: Shuichi Koganehira, Nagano (JP); Tsuyoshi Hayashi, Nagano (JP); Yasuhiko Kosugi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/859,891

(22) Filed: Jan. 2, 2018

(65) Prior Publication Data

US 2018/0214904 A1 Aug. 2, 2018

(30) Foreign Application Priority Data

Jan. 27, 2017 (JP) ..... 2017-012630

(51) Int. Cl.

| | |
|---|---|
| ***B05C 11/10*** | (2006.01) |
| ***B05C 5/02*** | (2006.01) |
| ***B41J 2/175*** | (2006.01) |

(52) U.S. Cl.

CPC ..... *B05C 11/1007* (2013.01); *B05C 5/027* (2013.01); *B41J 2/175* (2013.01); *B41J 2/17509* (2013.01); *B41J 2/17566* (2013.01); *B41J 2/17596* (2013.01); *B41J 2002/17569* (2013.01)

(58) Field of Classification Search

CPC .. B05C 11/1007; B05C 5/027; B41J 2/17596; B41J 2/17566; B41J 2/17509; B41J 2/175; B41J 2002/17569

See application file for complete search history.

(56) References Cited

U.S. PATENT DOCUMENTS

2018/0370241 A1* 12/2018 Koganehira ..... B41J 2/175

FOREIGN PATENT DOCUMENTS

| | | |
|---|---|---|
| JP | 2010-201810 A | 9/2010 |
| JP | 2010-228112 A | 10/2010 |

* cited by examiner

*Primary Examiner* — Justin Seo

(74) *Attorney, Agent, or Firm* — Global IP Counselors, LLP

(57) ABSTRACT

The control unit, when a first condition in which a minimum value of a suppliable time that is a time it takes for an amount of liquid contained in each supply-side sub tank to reach an amount corresponding to a switching preparation time necessary for switching between the refill-side sub tank and the supply-side sub tank is less than or equal to a maximum value of a full refill refilling time that is a period from when refill processing for performing refilling of the liquid from the main tank is started in each of the plurality of refill-side sub tanks until a state is achieved in which the refill-side sub tank is fully re-filled with liquid and can supply the liquid is satisfied, the refill processing is performed on the plurality of refill-side sub tanks.

6 Claims, 7 Drawing Sheets

LIQUID EJECTION SYSTEM AND COMPUTER PROGRAM

BACKGROUND

Priority is claimed under 35 U.S.C. § 119 to Japanese Applications No. 2017-012630 filed on Jan. 27, 2017 which is hereby incorporated by reference in their entirety.

1. Technical Field

The present invention relates to techniques of liquid ejection systems.

2. Related Art

Heretofore, a technique is known in which, in a liquid ejection system including a sub tank between a head and a main tank that stores liquid, the main tank and the sub tank are connected by a liquid supply tube, and the sub tank can be refilled with the ink in the main tank (JP-A-2010-228112, $f_{or}$ example). After the liquid in the main tank has been consumed, the main tank is replaced with a new main tank.

In the case where the head includes ejection outlets respectively corresponding to ink of a plurality of colors such that the head can eject ink of the plurality of colors, the liquid ejection system includes a plurality of sub tanks and main tanks respectively corresponding to the plurality of colors. Also, there are cases where a plurality of sub tanks are provided for each color. In this case, there is a risk that the control to switch between a sub tank that is refilled with liquid from a main tank and a sub tank that supplies liquid to the head will be complicated. Also, in this case, replacement of a main tank and refilling of ink from a main tank to a sub tank are desired to be performed at an appropriate timing. In the case where the refilling of ink from a main tank to a sub tank is executed many times more than necessary, inconveniences such as units of the printing device being damaged and the period of time during which printing cannot be performed becomes excessively long can occur. Also, in the case where the replacement of a main tank is performed many times more than necessary, there is a risk that a user who performs the replacement of the main tank will be heavily burdened.

The problem described above is not limited to the printing device, and is common among liquid ejection systems that include main tanks and sub tanks that contain various types of liquid and a head that ejects the various types of liquid.

SUMMARY

Advantages of some aspects of the invention are realized as the following embodiments and application examples.

(1) According to one aspect of the invention a liquid ejection device is provided. The liquid ejection device includes: a head including a plurality of types of ejection outlets for ejecting a plurality of types of liquid onto a medium; a sub tank unit including sub tank sets for the respective plurality of types of ejection outlets, each of the sub tank sets being constituted by a plurality of sub tanks that are in communication with the ejection outlet in parallel, and can contain the liquid to be supplied to the ejection outlet; main tanks that are provided for the respective sub tank sets, each of the main tanks being in communication with the plurality of sub tanks that constitute the sub tank set in parallel, and containing liquid to be supplied to the sub tanks; and a control unit that controls the operations of the liquid ejection system, and switches the sub tanks in each of the sub tank sets between one supply-side sub tank that can supply liquid to the ejection outlet and the other refill-side sub tank that can be refilled with liquid from the main tank. The control unit, when a first condition in which a minimum value of a suppliable time that is a time it takes for an amount of liquid contained in each supply-side sub tank to reach an amount corresponding to a switching preparation time necessary for switching between the refill-side sub tank and the supply-side sub tank is less than or equal to a maximum value of a full refill refilling time that is a period from when refill processing for performing refilling of the liquid from the main tank is started in each of the plurality of refill-side sub tanks until a state is achieved in which the refill-side sub tank is fully re-filled with liquid and can supply the liquid is satisfied, performs the refill processing on the plurality of refill-side sub tanks.

According to this aspect, when the first condition is satisfied, all of the refill-side sub tanks including the refill-side sub tank whose full refill refilling time is the longest can be refilled with liquid. Accordingly, switching for causing the refill-side sub tanks for respective types of liquid to each function as the supply-side sub tanks can be performed at the same time, and therefore the possibility of the switching control becoming complicated can be reduced.

(2) In the aspect described above, the control unit may execute the refill processing until either of a condition in which all the refill-side sub tanks are each fully refilled with the liquid and a condition in which at least one of the plurality of main tanks has entered an empty state with respect to the liquid remaining amount and the refill-side sub tank that is refilled with the liquid from a main tank other than the main tank that has entered the empty state is fully refilled with the liquid is satisfied. According to the aspect, an increase in number of times the refill processing is performed can be suppressed.

(3) In the aspect described above, the control unit may, in a case where a second condition in which a minimum value of the suppliable time of each of the plurality of supply-side sub tanks is greater than or equal to a maximum refilling time that is a time it takes for the fully refilled refill-side sub tank that has entered an empty state with respect to liquid to enter a state of being filled again with the liquid and being able to supply the liquid, in either of a first case that is a state immediately after switching between the supply-side sub tank and the refill-side sub tank is performed and a second case in which, in the refill-side sub tank and the main tank for containing the same type of liquid, the liquid consumed amount when the refill-side sub tank functioned as the supply-side sub tank is greater than or equal to the liquid remaining amount in the main tank, execute refill processing for performing refilling of the liquid from the main tank regardless of whether or not the first condition is satisfied. According to the aspect, because the refill-side sub tank immediately after the switching is performed can be refilled with liquid, all the sub tanks can be fully refilled with liquid at an earlier time. Also, according to the aspect, as a result of executing the refill processing when the liquid consumed amount in the refill-side sub tank is larger than the liquid remaining amount in the main tank, the liquid in the main tank 20 can be completely consumed at an earlier time before the first condition is satisfied. Accordingly, a user can be prompted to replace the main tank with a new main tank before executing the refill processing when the first condition is satisfied.

(4) In the aspect described above, the control unit may, in a case where the second condition is satisfied and the refill processing is executed in the second case, execute preparation urging processing for prompting the preparation of a new main tank, before the refill processing is executed, or while the refill processing is being executed, in order to replace the main tank corresponding to the second case with the new main tank. According to this aspect, when the main tank has entered an empty state with respect to the liquid remaining amount, a user can smoothly perform replacement with a new main tank.

(5) In the aspect described above, the control unit may not determine whether or not the first condition is satisfied in a period during which the refill processing is executed. According to the aspect, the possibility of the refill processing being stopped midway can be reduced.

(6) In the aspect described above, the control unit may, when at least one main tank among the plurality of main tanks enters an empty state with respect to the liquid remaining amount in a period during which the refill processing is executed, executes the replacement urging processing for prompting a user to replace the main tank that has entered an empty state with a new main tank after the refill processing ends. According to this aspect, the replacement of the main tank in a period during which the refill processing is executed can be suppressed.

Note that the invention can be achieved in various modes, and may be achieved not only as a liquid ejection system, but also in modes such as a control methods of a liquid ejection system, a computer program for controlling a liquid ejection system, and a storage medium storing the computer program.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. Embodiment

Figure 1:
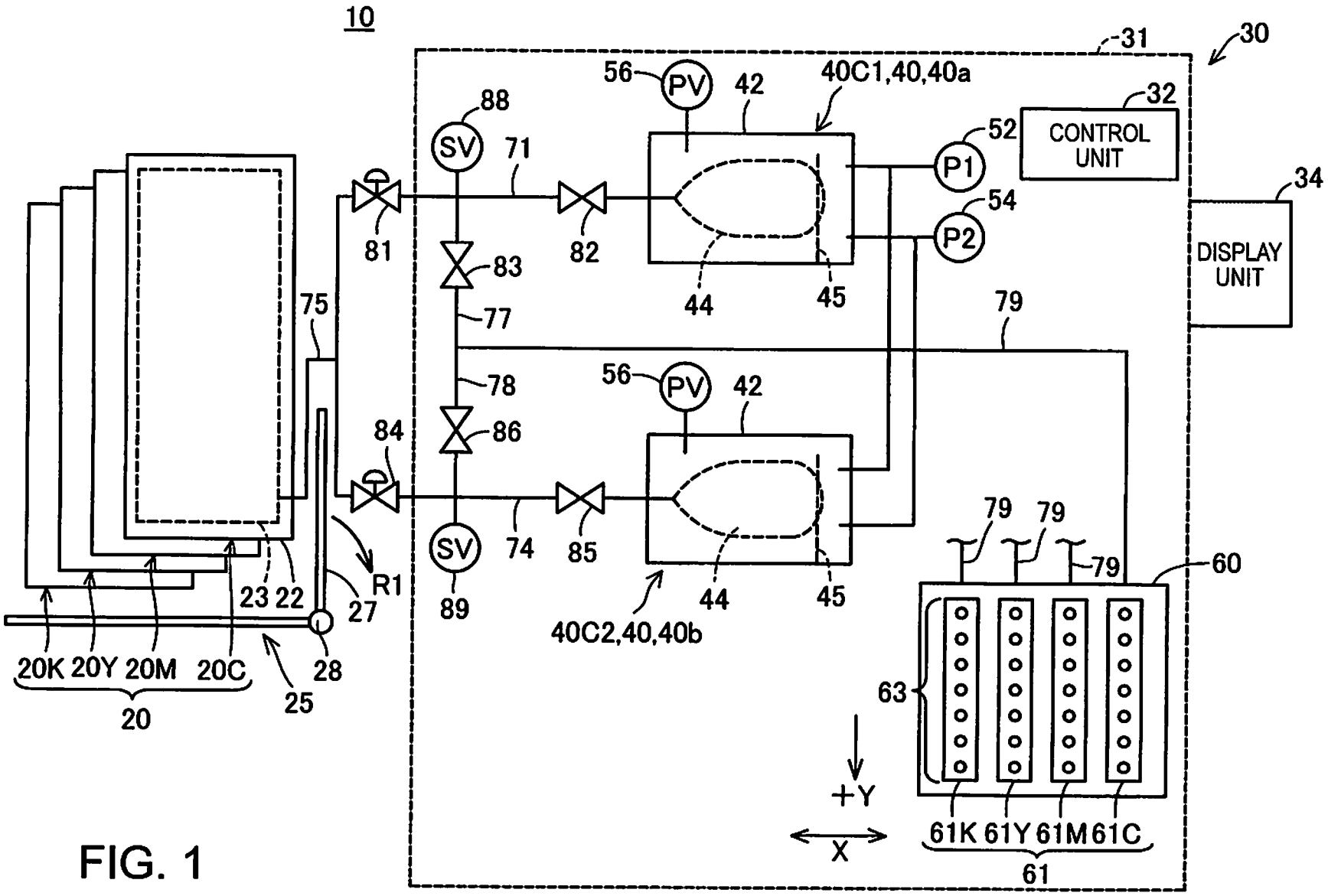
FIG. 1 is a schematic diagram of a liquid ejection system serving as an embodiment of the invention.
Figure 2:
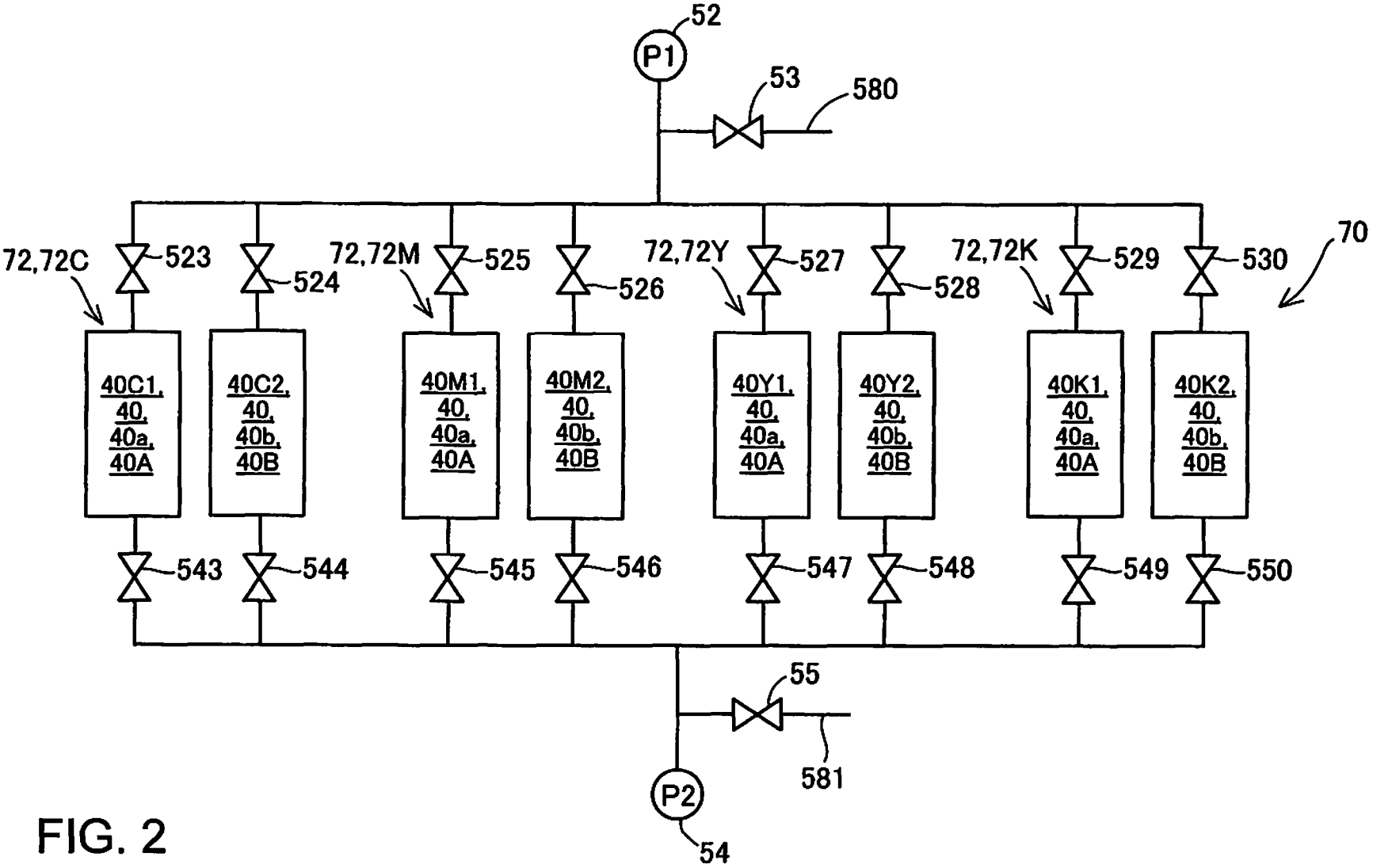
FIG. 2 is a diagram for describing a connection state of sub tanks, a supply pump, and a refill pump.

A-1: Configuration of Liquid Ejection System:

FIG. 1 is a schematic diagram of a liquid ejection system serving as an embodiment of the invention. FIG. 2 is a diagram for describing a connection state of sub tanks, a supply pump, and a refill pump, and is a control diagram of air pressure.

A liquid ejection system 10 includes main tanks 20 and a liquid ejection device 30. The main tanks 20 are arranged outside a housing of the liquid ejection device 30. Each main tank 20 can be replaced with a new main tank 20 by a user. When the four main tanks 20 are distinguished therebetween, reference signs "20C", "20M", "20Y", and "20K" are used. The four main tanks 20C to 20K respectively contain (are filled with) liquid of different types. In the present embodiment, yellow (Y) ink, magenta (M) ink, cyan (C) ink, and black (K) ink are respectively contained in the main tanks 20C to 20K, which are different from each other. The main tank 20C contains cyan liquid. The main tank 20M contains magenta liquid. The main tank 20Y contains yellow liquid. The main tank 20K contains black liquid. Each main tank 20 can contain a larger amount of liquid than a later-described sub tank 40. The liquid contained in the main tank 20 is ink containing a precipitation component (pigment), for example. The main tank 20 includes a container body 22 and a main liquid containing portion 23 housed in the container body 22. The main liquid containing portion 23 is a flexible bag member, and the volume decreases as the liquid is consumed.

One main tank 20 is provided for each of later-described sub tank sets 72C to 72K (FIG. 2), and is in communication with a plurality of sub tanks 40 in parallel that constitute a corresponding one of the sub tank sets 72C to 72K. The main tank 20 contains liquid to be supplied to the sub tanks 40.

The main tanks 20 (FIG. 1) are placed in a tank placement portion 25. Specifically, the main tanks 20 are placed on a bottom wall 26 of the tank placement portion 25. A liquid supply portion of the main tank 20 is exposed to the outside as a result of pivoting a main tank lever 27 that stands upward from the bottom wall 26 in an arrow R1 direction around a fulcrum 28. The liquid supply portion of the main tank 20 is a portion for supplying the liquid in the main liquid containing portion 23 to a connection member of a later-described liquid ejection device 30. A user pivots the main tank lever 27 in the arrow R1 direction so as to open the tank placement portion 25, and thereafter removes the connection member of the liquid ejection device 30 from the liquid supply portion of the main tank 20. The user raises the main tank 20 from which the connection member has been removed, and removes the main tank 20 from the tank placement portion 25. Thereafter, the user places a new main tank 20 on the bottom wall 26 of the tank placement portion 25. Then, after connecting the liquid supply portion of the new main tank 20 and the connection portion of the liquid ejection device 30, the user closes the tank placement portion 25 by pivoting the main tank lever 27 in the direction opposite to the arrow R1 direction. Accordingly, the user can replace the main tank 20 with a new main tank 20.

The liquid ejection device 30 is an inkjet printer that performs recording (printing) by ejecting ink, which is an example of liquid, onto a medium such as paper. The liquid ejection device 30 includes an outer shell 31 that forms an outer surface, a control unit 32, a head 60, and a sub tank unit 70 (FIG. 2). The control unit 32 is arranged inside the outer shell 31, and controls the operations of the liquid ejection device 30.

The sub tank unit 70 is arranged inside the outer shell 31. The sub tank unit 70 includes, for each of a later-described plurality of types of ejection outlets 63 included in the head 60, a plurality of (two, in the present embodiment) sub tanks 40 that are in communication with the ejection outlets 63 in parallel. The sub tank set 72 is constituted by a plurality of sub tanks 40 that can contain liquid to be supplied to the ejection outlets 63. The sub tank unit 70 includes the sub tank sets 72 respectively corresponding to the plurality of types of ejection outlets 63. The sub tank set 72 that is in communication with ejection outlets 63 that eject cyan liquid is referred to as a sub tank set 72C as well, and the sub tank set 72 that is in communication with ejection outlets 63 that eject magenta liquid is referred to as a sub tank set 72M as well. Also, the sub tank set 72 that is in communication with ejection outlets 63 that eject yellow liquid is referred to as a sub tank set 72Y as well, and the sub tank set 72 that is in communication with ejection outlets 63 that eject black liquid is referred to as a sub tank set 72K as well.

Two sub tanks 40 are provided for each of the main tanks 20C to 20K. Two sub tanks 40C1 and 40C2, out of the plurality of sub tanks 40, corresponding to the main tank 20C that contains cyan liquid are illustrated in FIG. 1. In addition to the two sub tanks 40C1 and 40C2, two sub tanks 40M1 and 40M2 corresponding to the main tank 20M that contains magenta liquid, two sub tanks 40Y1 and 40Y2 corresponding to the main tank 20Y that contains yellow liquid, and two sub tanks 40K1 and 40K2 corresponding to the main tank 20K that contains black liquid are arranged inside the outer shell 31, as shown in FIG. 2. When the plurality of sub tanks 40C1 to 40K2 are not distinguished, they are referred to as "sub tanks 40". Out of the two sub tanks 40 for each of the plurality of types of liquid, one sub tank 40 is referred to as a first sub tank 40*a* as well, and the other sub tank 40 is referred to as a second sub tank 40*b* as well.

The head 60 is reciprocally moved along a predetermined direction (X direction in FIG. 1) by a drive mechanism (not shown). The head 60 includes nozzle lines 61 that eject liquid onto a medium. Four nozzle lines 61 are provided. When the four nozzle lines 61 are distinguished therebetween, reference signs "61C", "61M", "61Y", and "61K" are used. Each of the nozzle lines 61C to 61K includes a plurality of ejection outlets 63. The nozzle line 61C ejects cyan liquid that is supplied from one of the two sub tanks 40C1 and 40C2. The nozzle line 61M ejects magenta liquid that is supplied from one of the two sub tanks 40M1 and 40M2. The nozzle line 61Y ejects yellow liquid that is supplied from one of the two sub tanks 40Y1 and 40Y2. The nozzle line 61K ejects black liquid that is supplied from one of the two sub tanks 40K1 and 40K2. When recording (printing) is performed by ejecting liquid onto a medium, the head 60 is reciprocally moved along the X direction, and the medium is moved inside the outer shell 31 along a +Y direction orthogonally intersecting the X direction by a conveyance mechanism (not shown). Note that, in another embodiment, the head 60 may be a line head whose position is fixed without being reciprocally moved.

As described above, the head 60 includes the plurality of types of ejection outlets 63 for ejecting the plurality of types (cyan, magenta, yellow, and black colors) of liquid onto a medium. The plurality of types of ejection outlets 63 are respectively formed in the nozzle lines 61C to 61K, and eject different types of liquid.

Each sub tank 40 includes a case 42, a sub liquid containing portion 44 arranged inside the case 42, and a pressure sensor 56 that detects pressure inside the case 42. The case 42 is a housing substantially in the shape of a rectangular parallelepiped, and houses the sub liquid containing portion 44. The sub liquid containing portion 44 contains ink to be supplied to the head 60. The sub liquid containing portion 44 is a flexible bag member, and the volume decreases as the liquid is consumed. The pressure sensor 56 detects the pressure inside the case 42, and transmits a detection result to the control unit 32.

The sub tank 40 further includes agitation rollers 45 inside the case 42. Two agitation rollers 45 are provided so as to sandwich the sub liquid containing portion 44 (only one of them is shown in FIG. 1). According to an instruction from the control unit 32, the two agitation rollers 45 stir the liquid inside the sub liquid containing portion 44 by moving in a left and right direction in FIG. 1 while sandwiching the sub liquid containing portion 44.

The control unit 32 switches each of the plurality of (two, in the present embodiment) sub tanks 40*a* and 40*b* of each sub tank set 72 between a supply-side sub tank 40B in a state in which liquid can be supplied to the ejection outlets 63 and a refill-side sub tank 40A in a state in which the sub tank can be refilled with the liquid from the main tank 20. At a predetermined timing, the refill-side sub tank 40A is switched to the supply-side sub tank 40B, and the pre-switching supply-side sub tank 40B is switched to the refill-side sub tank 40A. Here, the plurality (two, in the present embodiment) of sub tanks 40 included in each sub tank set 72 are controlled such that, in a period during which one sub tank 40 (first sub tank 40*a*, for example) supplies liquid to the ejection outlets 63 in a period before the switching is executed, the remaining sub tank 40 (second sub tank 40*b*, for example) does not supply liquid to the ejection outlets 63.

The liquid ejection device 30 further includes a first refilling flow passage 71 and a second refilling flow passage 74 for bringing the main liquid containing portion 23 of the main tank 20 and the sub liquid containing portion 44 of the corresponding sub tank 40 into communication, and a first supply flow passage 77, a second supply flow passage 78, and a merged supply flow passage 79 for bringing the sub liquid containing portion 44 and the head 60 into communication. The first refilling flow passage 71 and the second refilling flow passage 74 branch from a connection flow passage 75.

Four of each of the flow passages 71, 74, 75, 77, 78, and 79 are provided corresponding to the four main tanks 20C to 20K. Note that only the flow passages 71, 74, 75, 77, 78, and 79 that are provided corresponding to the main tank 20C are shown in FIG. 1. The flow passages 71, 74, 77, 78, and 79 provided corresponding to each of the other main tanks 20M, 20Y, and 20K are also similarly configured.

The connection flow passage 75 includes, at one end portion, a connection portion (not shown) that is detachably connected to the liquid supply portion of the main tank 20. The other end portion of the connection flow passage 75 branches into the first refilling flow passage 71 and the second refilling flow passage 74.

The first refilling flow passage 71 brings the main liquid containing portion 23 of the main tank 20 and the sub liquid containing portion 44 of the first sub tank 40*a* into communication via the connection flow passage 75. The first refilling flow passage 71 is a flow passage for refilling the first sub tank 40*a* with the liquid in the main tank 20. A first open/close valve 81 and a first refill valve 82 are arranged in the middle of the first refilling flow passage 71. The first open/close valve 81 is arranged outside the outer shell 31, and can be operated by a user. The first open/close valve 81 opens and closes the first refilling flow passage 71. For example, when the main tank 20 is to be replaced, a user removes the main tank 20 from the first refilling flow passage 71 after closing the first open/close valve 81, and then opens the first open/close valve 81 after connecting a new main tank 20 to the first refilling flow passage 71. Also, the first open/close valve 81 can be opened and closed according to an instruction from the control unit 32. The first refill valve 82 opens and closes according to an instruction from the control unit 32, and opens and closes the first refilling flow passage 71.

The second refilling flow passage 74 brings the main liquid containing portion 23 of the main tank 20 and the sub liquid containing portion 44 of the second sub tank 40*b* into communication via the connection flow passage 75. The second refilling flow passage 74 is a flow passage for refilling the second sub tank 40*b* with the liquid in the main tank 20. A second open/close valve 84 and a second refill valve 85 are arranged in the middle of the second refilling flow passage 74. The second open/close valve 84 is arranged outside the outer shell 31, and can be operated by a user. For example, when the main tank 20 is to be replaced, a user removes the main tank 20 from the second refilling flow passage 74 after closing the second open/close valve 84, and then opens the second open/close valve 84 after connecting a new main tank 20 to the second refilling flow passage 74. Also, the second open/close valve 84 can be opened and closed according to an instruction from the control unit 32. The second refill valve 85 opens and closes according to an instruction from the control unit 32, and opens and closes the second refilling flow passage 74.

The first supply flow passage 77 is a flow passage that is connected to a portion of the first refilling flow passage 71 between the first refill valve 82 and the first open/close valve 81. A first supply valve 83 is arranged in the middle of the first supply flow passage 77. The first supply valve 83 opens and closes according to an instruction from the control unit 32.

The second supply flow passage 78 is a flow passage that is connected to a portion of the second refilling flow passage 74 between the second refill valve 85 and the second open/close valve 84. A second supply valve 86 is arranged in the middle of the second supply flow passage 78. The second supply valve 86 opens and closes according to an instruction from the control unit 32.

The merged supply flow passage 79 is a flow passage to which the first supply flow passage 77 and the second supply flow passage 78 merge. The merged supply flow passage 79 is in communication with the head 60 (specifically, corresponding nozzle line 61).

When the first sub tank 40*a* is refilled with liquid from the main tank 20, the first open/close valve 81 enters an open state, the first supply valve 83 enters a closed state, and the first refill valve 82 enters an open state. This state of open and closed states of the valves is referred to as a first refillable state. Accordingly, the first sub tank 40*a* can be refilled with the liquid from the main tank 20 via the first refilling flow passage 71. When the second sub tank 40*b* is refilled with liquid from the main tank 20, the second open/close valve 84 enters an open state, the second supply valve 86 enters a closed state, and the second refill valve 85 enters an open state. This state of open and closed states of the valves is referred to as a second refillable state. Accordingly, the second sub tank 40*b* can be refilled with the liquid from the main tank 20 via the second refilling flow passage 74.

When liquid is supplied from the first sub tank 40*a* to the head 60, the first open/close valve 81 enters a closed state, the first refill valve 82 enters an open state, and the first supply valve 83 enters an open state. This state of open and closed states of the valves is referred to as a first suppliable state. Accordingly, liquid can be supplied from the first sub tank 40*a* to the head 60 via a portion of the first refilling flow passage 71, the first supply flow passage 77, and the merged supply flow passage 79. When liquid is supplied from the second sub tank 40*b* to the head 60, the second open/close valve 84 enters a closed state, the second refill valve 85 enters an open state, and the second supply valve 86 enters an open state. This state of open and closed states of the valves is referred to as a second suppliable state. Accordingly, liquid can be supplied from the second sub tank 40*b* to the head 60 via a portion of the second refilling flow passage 74, the second supply flow passage 78, and the merged supply flow passage 79.

A first flow passage pressure sensor 88 is arranged in a first connection portion between the first refilling flow passage 71 and the first supply flow passage 77. The first flow passage pressure sensor 88 detects the flow passage pressure of the first connection portion, and transmits a detection result to the control unit 32. A second flow passage pressure sensor 89 is arranged in a second connection portion between the second refilling flow passage 74 and the second supply flow passage 78. The second flow passage pressure sensor 89 detects the flow passage pressure of the second connection portion, and transmits a detection result to the control unit 32.

The liquid ejection device 30 further includes a refill pump 52 and a supply pump 54, as shown in FIG. 2. The refill pump 52 and the supply pump 54 are shared between the plurality of sub tanks 40C1 to 40K2. The refill pump 52 and the supply pump 54 are controlled by the control unit 32.

In order to refill a sub tank 40 with liquid from the main tank 20, the refill pump 52 reduces the pressure inside the case 42 of the sub tank 40 that is the refill target to a predetermined pressure. In order to supply liquid from a sub tank 40 to the head 60, the supply pump 54 is used to increase the pressure inside the case 42 of the sub tank 40 that is a supply source to a predetermined pressure. Refill open/close valves 523 to 530 are arranged in the middle of respective flow passages that bring the refill pump 52 and the sub tanks 40 into communication. Also, supply open/close valves 543 to 550 are arranged in the middle of respective flow passages that bring the supply pump 54 and the sub tanks 40 into communication. The refill open/close valves 523 to 530 and the supply open/close valves 543 to 550 are controlled by the control unit 32. Also, a flow passage 580 that is branched from a flow passage that is located between the refill pump 52 and the refill open/close valves 523 to 530 is provided. The flow passage 580 is in communication with the atmosphere. An open/close valve 53 is arranged in the middle of the flow passage 580. Also, a flow passage 581 that is branched from a flow passage that is located between the supply open/close valves 543 to 550 and the supply pump 54 is provided. This flow passage 581 is in communication with the atmosphere. An open/close valve 55 is arranged in the middle of the flow passage 581. The open/close valves 53 and 55 are controlled by the control unit 32. The open/close valve 55 enters an open state only when the liquid ejection device 30 is turned off, in principle.

The liquid ejection device 30 further includes a display unit 34 that is arranged such that a user can view it, as shown in FIG. 1. The display unit 34 displays information such as a message according to a request from a user.

Figure 3:
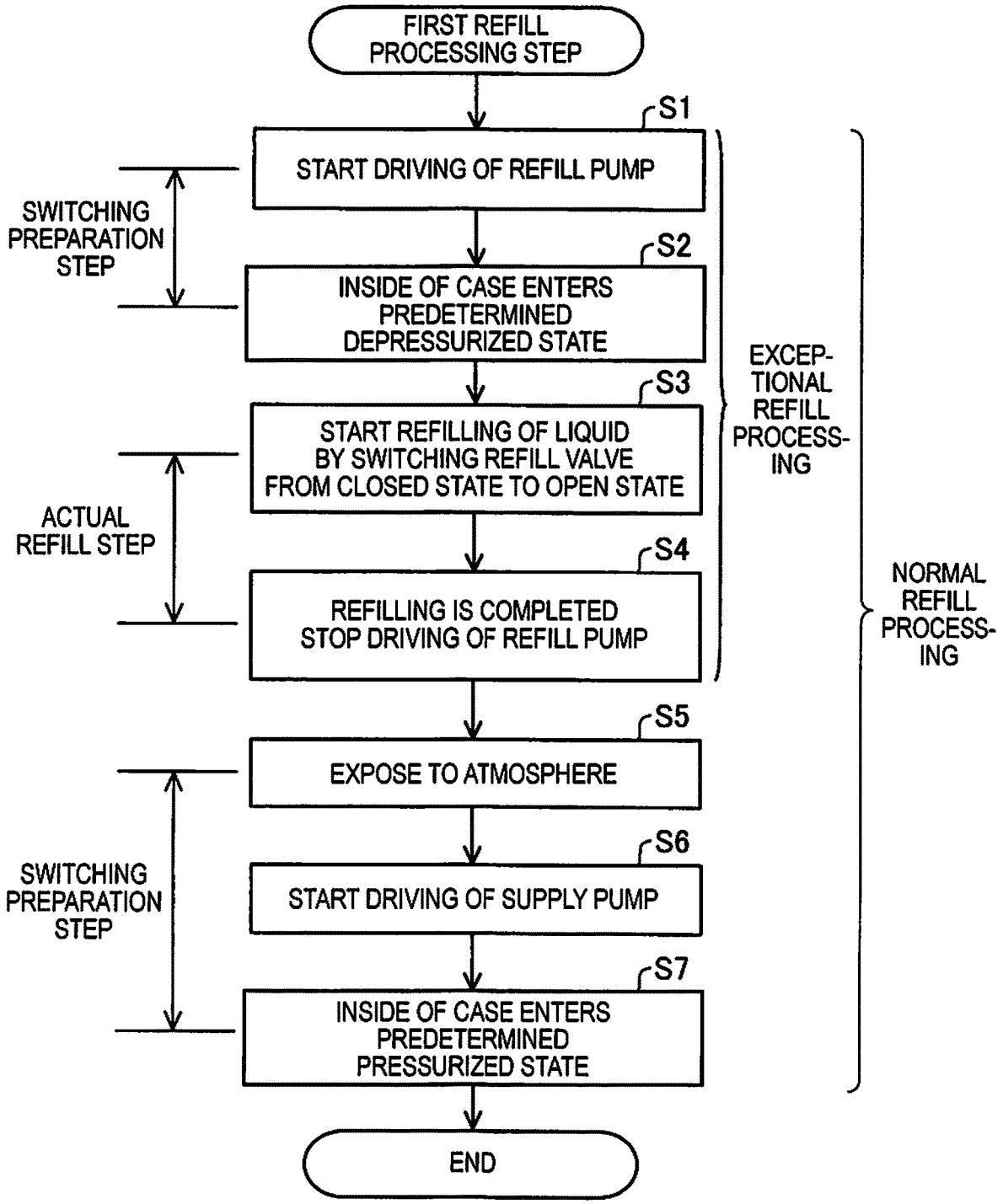
FIG. 3 is a flow diagram for describing a first refill processing step performed on a sub tank.
Figure 4:
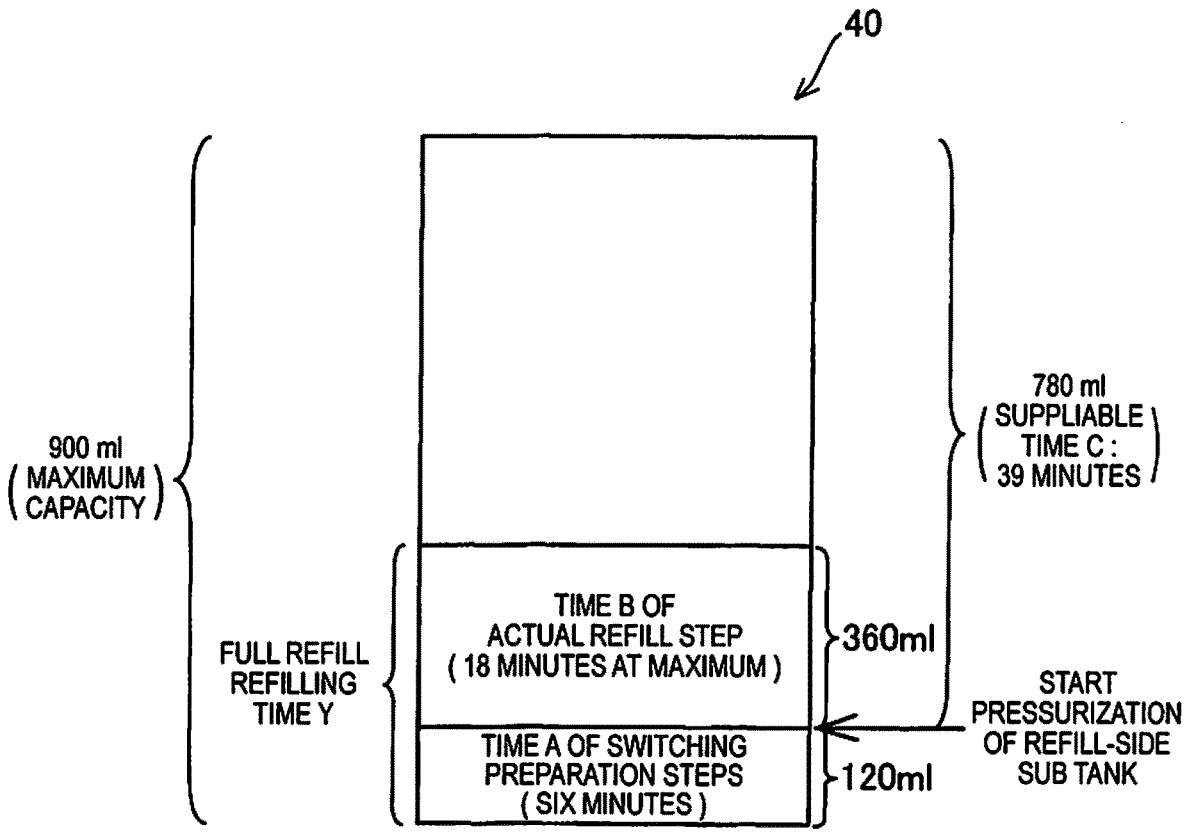
FIG. 4 is a diagram for describing a relationship between refilling of and supply from a sub tank.

A-2. Sub Tank Refilling Step:

FIG. 3 is a flow diagram for describing a first refill processing step performed on a sub tank 40. FIG. 4 is a diagram for describing a relationship between refilling of and supply from a first sub tank 40*a* and a second sub tank 40*b*.

Also, in the present embodiment, the maximum capacity of a sub tank 40 is 900 ml, the liquid refilling speed from the main tank 20 to the refill-side sub tank 40A is 50 ml/min at the slowest including tolerance, and the maximum supply speed from the supply-side sub tank 40B to the head 60 is 20 ml/min at the fastest including tolerance. The maximum supply speed is the liquid supply speed from the supply-side sub tank 40B to the head 60 when single color solid printing is performed on a medium.

As shown in FIG. 3, the control unit 32 starts driving of the refill pump 52 after bringing the open/close valves 523 to 530 between the refill pump 52 and the refill-side sub tanks 40A into an open state (step S1). For example, when the first sub tanks 40*a* of the respective colors are each the refill-side sub tank 40A, the control unit 32 brings the open/close valves 523, 525, 527, and 529 shown in FIG. 2 into an open state, brings the open/close valves 524, 526, 528, and 530 into a closed state, and brings the open/close valve 53 into a closed state, and thereafter starts driving of the refill pump 52. On the other hand, in order to cause each of the second sub tanks 40*b* of the respective colors to function as the supply-side sub tank 40B, the control unit 32 brings the open/close valves 544, 546, 548, and 550 shown in FIG. 2 into an open state, brings the open/close valves 543, 545, 547, and 549 into a closed state, and brings the open/close valve 55 into a closed state, and thereafter supplies liquid to the head 60 by driving the supply pump 54.

After step S1, the control unit 32 drives the refill pump 52 until the inside of the case 42 of the refill-side sub tank 40A enters a predetermined depressurized state (step S2). The predetermined depressurized state is a state in which the pressure inside the case 42 is at a predetermined negative pressure in order to take in the liquid in the main tank 20. The control unit 32 detects the pressure inside the case 42 using the pressure sensor 56 of the refill-side sub tank 40A. The control unit 32 drives the refill pump 52 so as to maintain the predetermined depressurized state until the refilling of the refill-side sub tank 40A is completed.

Next, the control unit 32 switches the first refill valve 82 (FIG. 1) from a closed state to an open state, and starts refilling of the refill-side sub tanks 40A with the liquid from the respective main tanks 20 (step S3). In step S3, the first open/close valve 81 (FIG. 1) is set to an open state. As a result of switching the first refill valve 82 from a closed state to an open state, the sub liquid containing portion 44 of the refill-side sub tank 40A takes in the liquid in the main liquid containing portion 23 via the first refilling flow passage 71.

After the refilling of the refill-side sub tank 40A is completed, the control unit 32 stops driving of the refill pump 52 (step S4). Also, in step S4, the control unit 32 switches the first refill valve 82 from an open state to a closed state. Note that the actual refilling time of the refill-side sub tank 40A with liquid from a state in which the liquid remaining amount is zero to the maximum capacity (900 ml) is 18 minutes in the present embodiment. The steps S3 and S4 are collectively referred to as an actual refill step. Note that, in a later-described exceptional refilling, the first refill processing step is ended after step S4 without performing step S5 onward.

After step S4, exposure to the atmosphere is performed on the refill-side sub tank 40A (step S5). The exposure to the atmosphere is a state in which the refill pump 52 and the supply pump 54 are not driven with respect to the refill-side sub tank 40A, and is a step in which the pressure inside the case 42, which is a negative pressure, is increased to the atmospheric pressure. The change in pressure from the negative pressure to the atmospheric pressure is realized by taking in ambient air into the case 42 via the flow passage 580 as a result of bringing the atmosphere exposure valve 53 into an open state, which is described in FIG. 2 and is located between the refill pump 52 and the open/close valves 523 to 530. The control unit 32 ends step S5 at a point in time when the pressure inside the case 42 detected by the pressure sensor 56 reaches the atmospheric pressure. Note that the time it takes to bring the depressurized state inside the case 42 to an atmospheric pressure state is several seconds, and this time is included in the execution time of a later-described switching preparation step.

After step S5, the control unit 32 starts driving of the supply pump 54 after bringing the open/close valves 543, 545, 547, and 549 between the supply pump 54 and the refill-side sub tanks 40A into an open state (step S6). The control unit 32 drives the supply pump 54 until the inside of the case 42 of each refill-side sub tank 40A enters a predetermined pressurized state (step S7). The predetermined pressurized state is a pressure state for supplying liquid to the head 60, and is a state in which the pressure inside the case 42 is a predetermined pressure higher than the atmospheric pressure. Accordingly, the refill-side sub tank 40A is switched to the supply-side sub tank 40B, and a state in which liquid can be supplied to the head 60 is achieved. In actuality, as a result of performing control such that the first open/close valve 81 enters a closed state, the first refill valve 82 enters an open state, and the first supply valve 83 enters an open state, the refill-side sub tank 40A is switched to the supply-side sub tank 40B, and the supply of liquid to the head 60 is started.

Here, steps S1 and S2, and steps S5 to S7 are steps in which refilling of liquid from the main tank 20 and supply of liquid to the head 60 are not performed, and can be said to be steps necessary for performing pressure control in order to switch between the refill-side sub tank 40A that can be refilled with the liquid from the main tank 20 and the supply-side sub tank 40B. Therefore, steps S1 and S2 and steps S5 to S7 are also referred to as switching preparation steps.

First refill processing in refill processing that is executed when a later-described Expression (2) is less than or equal to zero is normal refill processing, and steps S1 to S7 are executed. On the other hand, first refill processing in refill processing that is executed when a later-described Expression (1) is greater than or equal to zero is exceptional refill processing, and steps S1 to S5 are executed.

As shown in FIG. 4, in the present embodiment, the execution time (also referred to as "switching preparation time A") of the switching preparation steps is six minutes, and the execution time B of the actual refill step is 18 minutes at the maximum. The switching preparation time A is the time necessary for switching between the refill-side sub tank 40A and the supply-side sub tank 40B, and is the time in which pressure control for switching is performed. The time from the start to the end of the refilling step (full refill refilling time Y) is 24 minutes at the maximum, and liquid of an amount that is more than the amount that the supply-side sub tank 40B can supply to the head 60 during this 24 minutes needs to be contained in the supply-side sub tank 40B. That is, unless 480 ml or more of liquid is contained in the supply-side sub tank 40B, it is possible that the liquid in the supply-side sub tank 40B will be completely consumed in the middle of the first refilling step. Also, the suppliable time C (that is, printable time) during which the supply-side sub tank 40B can supply liquid to the ejection outlets 63 excluding the time A (six minutes) of the switching preparation step of the refill-side sub tank 40A is 39 minutes (780120) at the maximum.

Figure 5:
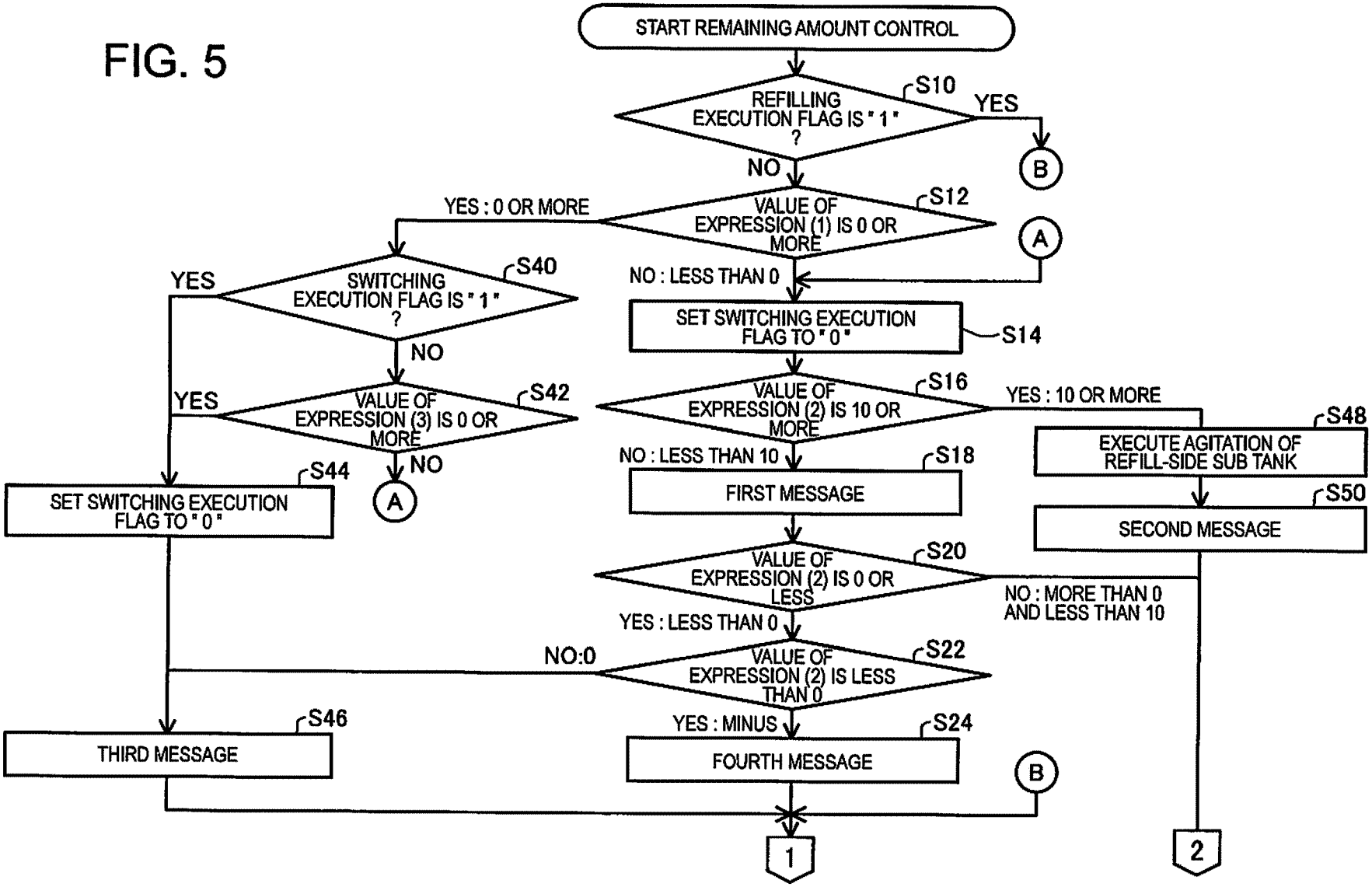
FIG. 5 is a first flow diagram of a remaining amount control step executed by a control unit.
Figure 6:
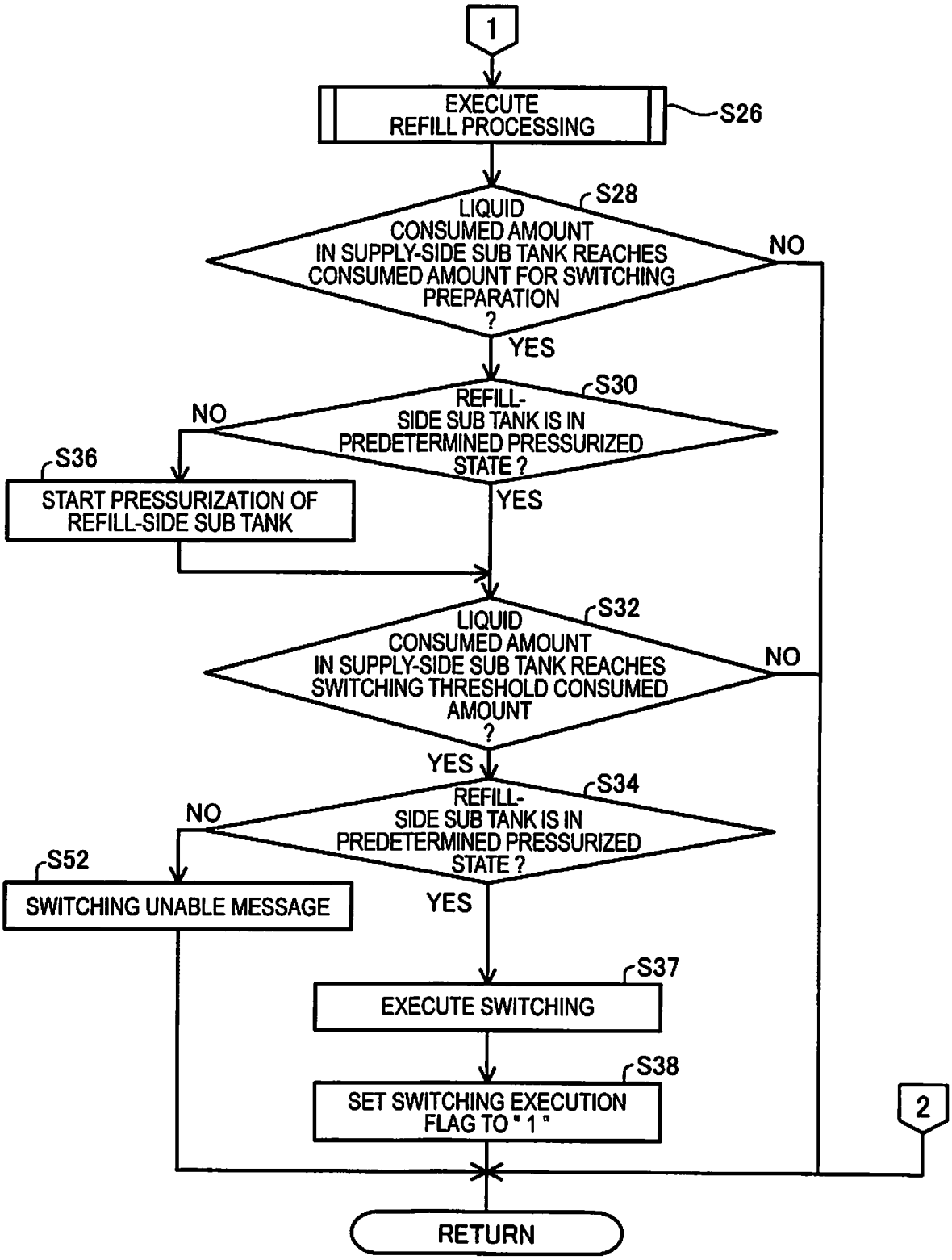
FIG. 6 is a second flow diagram of the remaining amount control step executed by the control unit.
Figure 7:
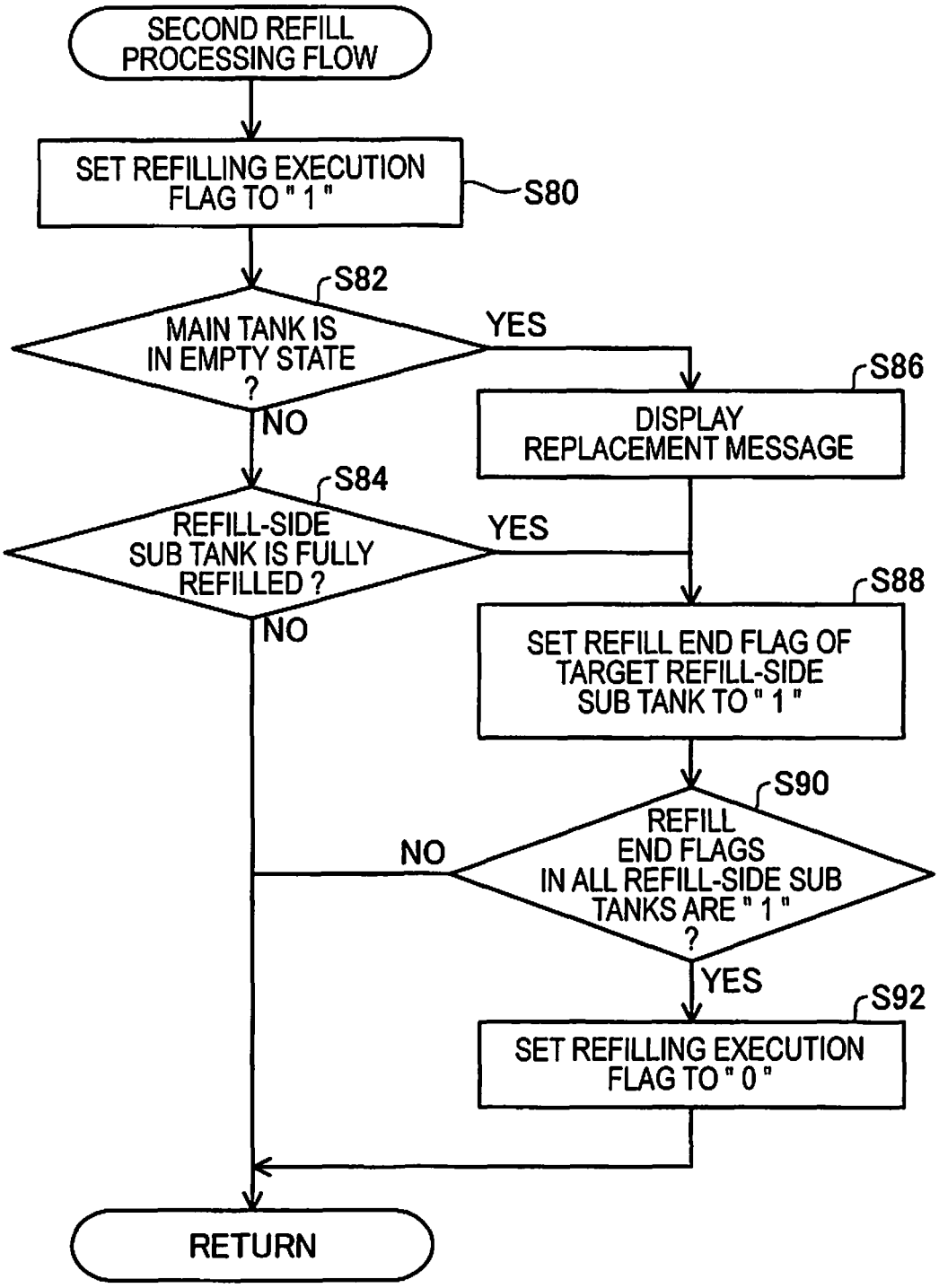
FIG. 7 is a flow diagram of a second refill processing step, which is one process of the remaining amount control step.

A-3. Remaining Amount Control Step:

FIG. 5 is a first flow diagram of a remaining amount control step executed by the control unit 32. FIG. 6 is a second flow diagram of the remaining amount control step executed by the control unit 32. FIG. 7 is a flow diagram of a second refill processing step, which is one process of the remaining amount control step. The second refill processing step in FIG. 7 is executed while the actual refill step in the first refill processing step in FIG. 3 is executed. Also, various flags (refilling execution flag and switching execution flag, for example) that appear in the following description are stored in the control unit 32.

The remaining amount control step is executed every time when any of the nozzle lines 61C to 61K of the head 60 has consumed a predetermined amount of liquid. The predetermined amount is 0.2 ml in the present embodiment. First, the control unit 32 determines whether or not the refilling execution flag is "1" (step S10). If the refilling execution flag is "1" (step S10: YES), the refill processing is being executed (step S26 in FIG. 6).

If the refilling execution flag is "0" instead of "1" (step S10: NO), the control unit 32 executes step S12. Step S12 is a step for determining whether or not the value of Expression (1) is greater than or equal to zero. The maximum value (maximum refilling time) of the full refill refilling time Y is the time it takes for the refill-side sub tank 40A in a state of the liquid remaining amount being zero to be refilled with liquid to the maximum capacity (900 ml) as shown in FIG. 4, and is a fixed value.

minimum value of suppliable times C of respective plurality (colors) of supply-side sub tanks 40B− maximum refilling time Expression (1):

Here, the maximum refilling time is a time it takes, when the first refill processing is executed on the refill-side sub tank 40A in an empty state, for the refill-side sub tank 40A to be fully refilled with liquid so as to be able to supply liquid, and is a fixed value of 24 minutes, in the present embodiment. The sum of the time needed to achieve a predetermined depressurized state from the atmospheric pressure state (including pressurized state) and the time needed to achieve a predetermined pressurized state from the atmospheric pressure state (including depressurized state) is the switching preparation time A (six minutes at the maximum). Also, in the case where the refill-side sub tank 40A in an empty state and the predetermined depressurized state is started to be refilled with liquid, since the maximum refilling speed is 50 ml/minute, the refill-side sub tank 40A can enter a fully refilled state in 18 minutes at the maximum. Therefore, the full refill refilling time Y in the present embodiment is 24 minutes. That is, if the refill-side sub tank 40A starts the first refill processing at the point in time when liquid of an amount that is more than the amount that may be consumed in 24 minutes remains in the supply-side sub tank 40B, the refill-side sub tank 40A can be brought into the predetermined pressurized state until the supply-side sub tank 40B enters the empty state. However, in the case where the maximum suppliable time C is estimated with reference to 900 ml, which is the maximum capacity of the supply-side sub tank 40B, the point in time when the pressurization of the refill-side sub tank 40A is started becomes uncertain. Therefore, in the present embodiment, the maximum suppliable time C is estimated with reference to 780 ml.

In step S12, if the value of Expression (1) is less than zero (step S12: NO), the control unit 32 sets the switching execution flag to "0" (step S14). The switching execution flag to be set in the control unit 32 is a flag for determining whether or not switching of the two sub tanks 40 provided for each of the liquid colors between the refill-side sub tank 40A and the supply-side sub tank 40B has been executed in the previous routine. If the switching between the refill-side sub tank 40A and supply-side sub tank 406 has not been performed in the previous routine, the switching execution flag in the control unit 32 is set to "0". In the case where the supply-side sub tank 40B has been switched to the refill-side sub tank 40A and the refill-side sub tank 40A has been switched to the supply-side sub tank 40B in the previous routine, the switching execution flag in the control unit 32 is set to "1".

After step S14, the control unit 32 determines whether or not the value of the following Expression (2) is greater than or equal to ten (step S16). Here, ten (minutes) is the estimated maximum time it takes for a user to perform an agitation operation on the main tank 20, but this value may be another value.

minimum value of suppliable times C of respective plurality (colors) of supply-side sub tanks 40B− maximum value of full refill refilling times Y of respective plurality (cyan, magenta, yellow, and black) of refill-side sub tanks 40A Expression (2):

In step S16, if the value of Expression (2) is less than 10 (step S16: NO), the control unit 32 displays a first message notifying the user that the user should not open the main tank lever 27, in the display unit 34 (step S18). The first message is "Do not open the main tank lever in order to continue printing", for example.

After step S18, the control unit 32 determines whether or not the value of Expression (2) is less than or equal to zero (step S20). If the value of Expression (2) (step S20: NO) is larger than zero, this routine is ended. That is, in the case where the value of Expression (2) is larger than zero, printing can be performed for a time that is longer than the full refill refilling times Y of the refill-side sub tanks 40A of respective colors using the supply-side sub tanks 40B of respective colors, at the current point in time.

If the value of Expression (2) is less than or equal to zero (step S20: YES), the control unit 32 determines whether or not the value of Expression (2) is less than zero (step S22). If the value of Expression (2) is less than zero (step S22: YES), the control unit 32 displays a fourth message notifying that printing may stop, in the display unit 34. The fourth message is "Printing may stop midway", for example. That is, if "YES" in step S22, there is a risk that the refill-side sub tank 40A cannot be switched to the supply-side sub tank 40B before the liquid in any of the supply-side sub tanks 40B of respective colors is totally consumed. After step S24, the control unit 32 executes the refill processing (step S26 in FIG. 6).

In step S22, if the value of Expression (2) is not less than zero, that is, if the value is zero (step S22: NO), the control unit 32 displays a third message notifying the user that the refill processing will be executed in the display unit 34 (step S46). The third message is "Refilling in progress. Do not open the main tank lever during refilling.", for example. Then, after step S46, the control unit 32 executes the refill processing (step S26 in FIG. 6).

If the value of Expression (2) is greater than or equal to ten in step S16 (step S16: YES), the control unit 32 executes stirring of the refill-side sub tank 40A (step S48). Specifically, the control unit 32 stirs the liquid in the sub liquid containing portion 44 included in the refill-side sub tank 40A by moving the agitation rollers 45. Also, the control unit 32 displays a second message notifying the user that the liquid in the main tank 20 should be stirred, in the display unit 34 (step S50). The second message is "After agitating the main tank, immediately install the main tank and close the main tank lever.", for example. That is, in the case where enough of the liquid in the supply-side sub tank 40B remains so that immediate refilling of the refill-side sub tank 40A is not required, stirring of liquid in the refill-side sub tank 40A and the main tank 20 is performed. Accordingly, the possibility that unevenness occurs in the concentration distribution in the liquid in the refill-side sub tank 40A and the main tank 20 can be reduced.

In step S12, if the value of Expression (1) is greater than or equal to zero (step S12: YES), the control unit 32 determines whether or not the switching execution flag is "1" (step S40). If the switching execution flag is "1" (step S40: NO), the control unit 32 sets the switching execution flag to "0" (step S44), and displays the third message in the display unit 34 (step S46). Then, the control unit 32 executes the refill processing (step S26 in FIG. 6).

If the switching execution flag is not "1" and is "0" (step S40: NO), the control unit 32 determines whether or not the value of Expression (3) is greater than or equal to zero (step S42).

liquid consumed amount in refill-side sub tank 40A− liquid remaining amount in main tank 20 Expression (3):

Here, in Expression (3), the refill-side sub tank 40A and the main tank 20 are a refill-side sub tank 40A and a main tank 20 that contain the same type (color) of liquid. The liquid consumed amount in refill-side sub tank 40A is estimated by the control unit 32. The control unit 32 counts the number of dots that have been ejected from the head while the refill-side sub tank 40A functioned as the supply-side sub tank 40B, and estimates the liquid consumed amount based on the liquid amount consumed per dot and the number of counted dots. Also, the liquid remaining amount in the main tank 20 is estimated by the control unit 32 based on the sum of time during which the first refill valve 82 or the second refill valve 85 are in an open state while the refill processing is executed, and the refilling speed (50 ml/min).

If the value of Expression (3) is greater than or equal to zero (step S42: YES), the control unit 32 executes the refilling step (step S26 in FIG. 6) after executing steps S44 and S46. If the value of Expression (3) is less than zero (step S42: NO), the control unit 32 executes processing in step S14 and onward.

Next, the switching processing between the refill-side sub tank 40A on which the refill processing in step S26 has been completed and the supply-side sub tank 40B will be described based on FIG. 6. The switching processing is processing in which the current refill-side sub tank 40A is switched to the supply-side sub tank 40B for supplying liquid to the head 60, and the current supply-side sub tank 40B is switched to the refill-side sub tank 40A that is to be refilled with liquid from the main tank 20.

After step S26, the control unit 32 determines whether or not the liquid consumed amount in any of the supply-side sub tanks 40B of the plurality of supply-side sub tanks 40B (four supply-side sub tanks 40B provided for respective colors, in the present embodiment) has reached the consumed amount for switching preparation (step S28). The consumed amount for switching preparation is a value obtained by subtracting the maximum liquid amount (120 ml in the present embodiment) that the supply-side sub tank 40B supplies to the head 60 in the period (six minutes in present embodiment) of the switching preparation step of the refill-side sub tank 40A from the maximum capacity (900 ml, in the present embodiment) of the supply-side sub tank 40B, and is 780 ml in the present embodiment. That is, the consumed amount for switching preparation is the amount of liquid that the supply-side sub tank 40B can consume before starting the switching preparation step. If the liquid consumed amount in each of the supply-side sub tanks 40B does not reach the consumed amount for switching preparation (step S28: NO), the present routine is ended.

On the other hand, if the liquid consumed amount in any of the supply-side sub tanks 40B reaches the consumed amount for switching preparation (step S28: YES), the control unit 32 determines whether or not the inside of the case 42 of the refill-side sub tank 40A is in the predetermined pressurized state (step S30). If the inside of the case 42 is in the predetermined pressurized state (step S30: YES), the control unit 32 determines whether or not the liquid consumed amount in the supply-side sub tank 40B has reached a switching threshold consumed amount (step S32). The switching threshold consumed amount is the liquid amount when all of the liquid of the maximum capacity (900 ml, in the present embodiment) of the supply-side sub tank 40B is consumed, and is 900 ml in the present embodiment. If the inside of the case 42 is not in the predetermined pressurized state (step S30: NO), the control unit 32 starts pressurization by driving the supply pump 54 such that the inside of the case 42 of the refill-side sub tank 40A enters the predetermined pressurized state (step S36). The control unit 32 executes step S32 after step S36.

If the liquid consumed amount in the supply-side sub tank 40B has not reached the switching threshold consumed amount (step S32: NO), the control unit 32 ends the present routine. On the other hand, if the liquid consumed amount in the supply-side sub tank 40B has reached the switching threshold consumed amount (step S32: YES), the control unit 32 again determines whether or not the inside of the case 42 of the refill-side sub tank 40A is in the predetermined pressurized state (step S34). If the inside of the case 42 is not in the predetermined pressurized state (step S34: NO), the control unit 32 displays a switching unable message that indicates that the switching between the refill-side sub tank 40A and the supply-side sub tank 40B is not possible, in the display unit 34. That is, if the determination in step S34 is "NO", even if the refill-side sub tank 40A is switched to the supply-side sub tank 40B, there is a risk that the supply-side sub tank 40B after switching cannot supply enough liquid for printing to the head 60. Therefore, the control unit 32 displays the switching unable message in the display unit 34. In step S38, the switching execution flag is set to "1", and the atmosphere exposure valve 55 (FIG. 2) that is located between the supply pump 54 and the open/close valves 543 to 550 is brought into an open state. Accordingly, the supply-side sub tank 40B is exposed to the atmosphere via the flow passage 581. The time required to switch the pressurized state to the atmospheric pressure state is several seconds, and is included in the execution time (switching preparation time A) of the switching preparation time.

On the other hand, if the inside of the case 42 is in the predetermined pressurized state (step S34: YES), the control unit 32 executes switching (step S37) by controlling various valves (first supply valve 83 and second supply valve 86 in FIG. 1) such that the refill-side sub tank 40A functions as the supply-side sub tank 40B and the supply-side sub tank 40B functions as the refill-side sub tank 40A. The control unit 32 sets the switching execution flag to "1" after step S37, and ends the present routine.

Next, a second refill processing flow will be described using FIG. 7. The second refill processing flow in FIG. 7 is repeatedly executed at predetermined time intervals during the actual refill step shown in FIG. 3. If the refilling execution flag is "0", the control unit 32 sets the refilling execution flag to "1" (step S80). Next, whether or not the liquid remaining amount has reached zero (empty state) in at least one of the plurality of main tanks 20C, 20M, 20Y, and 20K is determined (step S82). If the liquid remaining amount is not zero in each of the main tanks 20C, 20M, 20Y, and 20K (step S82: NO), the control unit 32 determines whether or not at least one of the plurality of refill-side sub tanks 40A (of respective colors) is fully refilled to the maximum capacity (900 ml) (step S84). In this determination, first, the current liquid remaining amount (maximum capacity−estimated liquid consumed amount) is calculated from the liquid consumed amount estimated by the dot count immediately before the second refill processing flow is started (that is, the supply-side sub tank 40B before switching). Then, the liquid amount refilled during the actual refill step is added to the calculated liquid remaining amount, and when the added result reaches the maximum capacity (900 ml), the refill-side sub tank 40A is determined to have been fully refilled to the maximum capacity. Also, the determination target in step S84 is the refill-side sub tank 40A, out of the plurality of the refill-side sub tanks 40A, in which a later-described refill end flag is set to "0".

If each of the plurality of refill-side sub tanks 40A (of respective colors) is not filled to the maximum capacity (900 ml) (step S84: NO), the second refill processing flow is again executed. On the other hand, if at least any one of the plurality of refill-side sub tanks 40A (of respective colors) is filled to the maximum capacity (900 ml) (step S84: YES), the refill end flag is set to "1" in the refill-side sub tank 40A with respect to which "YES" was determined in step S84 (step S88). The refill end flag set to "1" indicates that the refill-side sub tank 40A to which the flag is set is fully refilled with liquid to the maximum capacity. After step S88, the control unit 32 determines whether or not the refill end flags in all of the (cyan, magenta, yellow, and black) refill-side sub tanks 40A are set to "1" (step S90). If the refill end flags in all of the refill-side sub tanks 40A are set to "1", the refilling execution flag is set to "0" (step S92). As a result of the refilling execution flag being changed from "1" to "0", the actual refill step (FIG. 3) is ended. On the other hand, if the refill end flag in any of the refill-side sub tanks 40A is not set to "1" (step S90: NO), the second refill processing is again executed.

Also, in step S82, if the liquid remaining amount is zero (empty state) in at least one of the plurality of main tanks 20C, 20M, 20Y, and 20K (step S82: YES), the control unit 32 displays a replacement message for prompting a user to replace the main tank 20 whose liquid remaining amount is zero, in the display unit 34 (step S86). The replacement message is a message indicating the color (cyan, magenta, yellow, black) of the replacement-target main tank 20 along with a message "Replace the main tank after completion of the refill processing for the next refill", for example. Also, the refill end flag of the refill-side sub tank 40A with respect to which "YES" was determined in step S82 is set to "1" (step S88).

In the present embodiment, as described above, when the first condition in which the minimum value of the suppliable time C is less than or equal to the maximum value of the full refill refilling time Y (Expression (2) is less than or equal to zero) is satisfied, the control unit 32 executes refill processing on the plurality of (cyan, magenta, yellow, and black) refill-side sub tanks 40A (step S20 in FIG. 2: YES, step S26 in FIG. 6). The minimum value of the suppliable time C is the minimum value of time it takes for the amount of liquid contained in each of the plurality of (cyan, magenta, yellow, and black) supply-side sub tanks 40B to reach the amount corresponding to the time A of the switching preparation step necessary for switching between a refill-side sub tank 40A and a supply-side sub tank 40B. The maximum value of the full refill refilling time Y is the maximum value of the time from when the refill processing for refilling each of the plurality of (cyan, magenta, yellow, and black) refill-side sub tanks 40A with liquid from the main tank 20 is started until the refill-side sub tank 40A is fully refilled with the liquid and the refill-side sub tank 40A enters a state in which the liquid is suppliable.

For example, when the suppliable time C of each of the three supply-side sub tanks 40B that respectively contain cyan liquid, magenta liquid, and yellow liquid is 24 minutes, and the suppliable time C of the supply-side sub tank 40B that contains black liquid is nine minutes, the minimum value of the suppliable time C is nine minutes. Also, when the full refill refilling time Y of each of the three refill-side sub tank 40A that respectively contain cyan liquid, magenta liquid, and yellow liquid is 24 minutes, and the full refill refilling time Y of the refill-side sub tank 40A that contains black liquid is nine minutes, the maximum value of the full refill refilling time Y is 24 minutes. Also, in this case, because the first condition in which Expression (2) is less than or equal to zero is satisfied, the refill processing (normal refill processing) is executed in each of the plurality of refill-side sub tanks 40A. Accordingly, all the refill-side sub tanks 40A including the supply-side sub tank 40B whose suppliable time C is the minimum value among the plurality of supply-side sub tanks 40B can be refilled with liquid. Accordingly, switching for causing the refill-side sub tanks 40A for respective types of liquid to each function as the supply-side sub tank 40B can be performed at the same time, and therefore the possibility of the switching control becoming complicated can be reduced.

Also, according to the embodiment described above, the control unit 32 executes the refill processing until either of the first refilling end condition and the second refilling end condition is satisfied. The first refilling end condition is a condition in which all the refill-side sub tanks 40A are fully refilled with liquid. The second refilling end condition is a condition in which the liquid remaining amount is in an empty state with respect to at least one of the plurality of main tanks 20C, 20M, 20Y, and 20K, and refill-side sub tanks 40A that are respectively refilled with liquid from the main tanks 20 other than the main tank 20 that has entered an empty state are fully refilled. Specifically, the first refilling end condition is a condition in which the flow from "step S82: NO" to "step S84: YES", "step S88", and "step S90: YES" in FIG. 7 is realized. Also, specifically, the second refilling end condition is a condition in which "step S90: YES" is satisfied via "step S82: YES" in FIG. 7. In this way, an increase in number of times the refill processing is performed can be suppressed. Also, the refill processing includes the process in which the inside of the sub tank 40 is pressurized and depressurized (switching preparation step in FIG. 3). When the pressurization and depressurization of the inside of the sub tank 40 are repeatedly executed, the deterioration of the case 42 and the sub liquid containing portion 44 may progress due to the stress caused by the pressurization and depressurization. However, since the number of executions of the refill processing can be suppressed in the embodiment described above, the progress of deterioration of the case 42 and the sub liquid containing portion 44 can be suppressed.

Also, according to the embodiment described above, if the second condition (step S12 in FIG. 5) is satisfied (step S12: YES), the control unit 32 executes the refill processing in which refilling of liquid from the main tank 20 is performed in either of a first case (step S40 in FIG. 5: YES) and a second case (step S42: YES) regardless of the first condition (Expression (2) is less than or equal to zero) being satisfied or not. The first case is a state immediately after the switching between the supply-side sub tank 40B and the refill-side sub tank 40A is performed. The second case is a case where, in the refill-side sub tank 40A and the main tank 20 for containing the same type of liquid, the liquid consumed amount when the refill-side sub tank 40A functioned as the supply-side sub tank 40B is greater than or equal to the liquid remaining amount in the main tank 20. The state immediately after the switching is performed indicates that the control unit 32 performed switching between the refill-side sub tank 40A and the supply-side sub tank 40B in the previous routine of controlling the remaining amount. The second condition is a condition in which the minimum value of the suppliable time C in each of the plurality of supply-side sub tanks 40B is greater than or equal to the time (maximum refilling time) it takes for the refill-side sub tank 40A in an empty state to enter a state of being fully refilled with liquid and being able to supply the liquid by executing the refill processing. Accordingly, because the refill-side sub tank 40A immediately after the switching is performed can be refilled with liquid, all of the sub tanks 40 can be fully refilled with liquid at an earlier time. Also, as a result of executing the refill processing when the liquid consumed amount in the refill-side sub tank 40A is larger than the liquid remaining amount in the main tank 20, the liquid in the main tank 20 can be completely consumed by being supplied to the sub tank 40 at an earlier time before the first condition is satisfied. Accordingly, a user can be prompted to replace the main tank 20 to a new main tank 20 before executing the refill processing when the first condition is satisfied.

Here, the control unit 32 may execute the following processing, in the case where the second condition is satisfied and the refill processing is executed in the second case, before the refill processing is executed, or while the refill processing is being executed. That is, the control unit 32 may execute preparation urging processing for prompting a user to prepare a new main tank 20 in order to replace the main tank 20 that corresponds to the second case with the new main tank 20. The preparation urging processing is processing in which a message notifying the user that a new main tank 20 should be prepared, in the display unit 34. Also, the preparation urging processing is not limited thereto, and may be performed by outputting sound or lighting a lamp. The state before executing the refill processing is in a period after "YES" is determined in step S42 until step S26 in FIG. 6 is executed, for example. Also, the period during which the refill processing is executed may be a period between step S80 and step S82 in FIG. 7, for example, or another period. In this way, when the main tank 20 enters an empty state with respect to the liquid remaining amount, a user can smoothly perform replacement with a new main tank 20.

Also, according to the embodiment described above, the control unit 32 does not determine whether or not the first condition is satisfied in a period during which the refill processing is executed (step S10: YES). With this, the possibility of stopping the refill processing midway can be reduced. For example, the stopping of refill processing in the case where the minimum value of the suppliable time C is larger than the maximum value of the full refill refilling time Y (step S20: NO) in a period during which the refill processing is executed can be suppressed.

Also, according to the embodiment described above, when at least one main tank 20 among the plurality of main tanks 20 enters an empty state with respect to the liquid remaining amount in a period during which the refill processing is executed, the control unit 32 executes the replacement urging processing (step S86 in FIG. 7) for prompting a user to replace the main tank 20 that has entered an empty state with a new main tank 20 after the refill processing ends. Accordingly, the replacement of the main tank 20 in a period during which the refill processing is executed can be suppressed.

B. Modifications

Note that this invention is not limited to the above examples and embodiment, and may be implemented in various modes without departing from the gist of the invention. For example, the following modifications are also possible.

B-1. First Modification:

In the embodiment described above, the empty state with respect to the liquid remaining amount is a state in which the amount of liquid is zero, but is not limited thereto, and may be a state in which the liquid remaining amount is almost zero. Also, in the embodiment described above, the refill-side sub tank 40A being fully refilled with liquid means that the refill-side sub tank 40A is filled with the liquid to the maximum capacity thereof, but is not limited thereto, and may mean that the refill-side sub tank 40A may be filled with the liquid to an amount close to the maximum capacity thereof.

B-2. Second Modification:

In the embodiment described above, the sub tank sets 72C to 72K each include two sub tanks 40, but may include three or more sub tanks 40. In this case, the switching is executed such that liquid is supplied to the ejection outlet 63 as a result of one of the three or more sub tanks 40 functioning as the supply-side sub tank 40B, and the remaining sub tank 40 each functions as the refill-side sub tank 40A.

B-3. Third Modification:

In the embodiment described above, the liquid contained in the main tanks 20 and the sub tanks 40 is ink including a precipitation component (pigment, for example), but the liquid may be a liquid that does not include a precipitation component (dye ink, for example).

B-4. Fourth Modification:

The invention can be applied to, not limited to an ink-jet printer, and a sub tank and a main tank for supplying ink to the ink-jet printer, any liquid ejection device that ejects liquid other than ink and a sub tank and a main tank for containing such liquid. For example, the invention can be applied to the following various liquid ejection devices and the liquid containers.

(1) Image recording apparatuses such as a facsimile apparatus (2) Color material ejection recording apparatuses used to manufacture color filters for image display apparatuses such as a liquid crystal display (3) Electrode material ejection apparatuses used to form electrodes for organic EL (Electro Luminescence) displays, field emission displays (FED), or the like (4) Liquid consuming apparatuses that eject liquid containing biological organic matter used to manufacture biochips (5) Sample ejection apparatuses serving as precision pipettes (6) Lubricating oil ejection apparatuses (7) Resin solution ejection apparatuses (8) Liquid consuming apparatuses that perform pinpoint ejection of lubricating oil to precision machines such as a watch and a camera (9) Liquid consuming apparatuses that eject transparent resin solution such as UV-cured resin solution onto substrates in order to form micro-hemispherical lenses (optical lenses) or the like used in optical communication elements or the like

(10) Liquid consuming apparatuses that eject acid or alkaline etchant in order to etch substrates or the like

(11) Liquid consuming apparatuses that include liquid consumption heads for discharging a very small amount of any other kinds of droplet.

Note that the "droplet" refers to a state of the liquid discharged from liquid consuming recording apparatuses or liquid consuming apparatuses, and includes droplets having a granular shape, a tear-drop shape, and a shape with a thread-like trailing end. The "Liquid" mentioned here need only be a material, the liquid state of which can be ejected by liquid consuming recording apparatuses or liquid consuming apparatuses. For example, the "liquid" need only be a material in a state where a substance is in a liquid phase, and a liquid material having a high or low viscosity, sol, gel water, and other liquid materials such as inorganic solvent, organic solvent, solution, liquid resin, and liquid metal (metallic melt) are also included as a "liquid". Furthermore, the "liquid" is not limited to being a single-state substance, and also includes particles of a functional material made from solid matter, such as pigment or metal particles, that are dissolved, dispersed, or mixed in a solvent, or the like. Representative examples of the liquid include ink such as that described in the above embodiment, liquid crystal, or the like. Here, the "ink" encompasses general water-based ink and oil-based ink, as well as various types of liquid compositions such as gel ink and hot melt ink.

The invention is not limited to the above embodiment and modifications, and can be achieved by various configurations without departing from the gist thereof. For example, the technical features in the embodiment and modifications that correspond to the technical features in the modes described in the summary of the invention can be replaced or combined as appropriate in order to solve some or all of the problems described above, or in order to achieve some or all of the above-described effects. A technical feature that is not described as essential in the specification can be deleted as appropriate.

What is claimed is:

1. A liquid ejection system comprising:

a head including a plurality of types of ejection outlets for ejecting a plurality of types of liquid onto a medium;

a sub tank unit including sub tank sets for the respective plurality of types of ejection outlets, each of the sub tank sets being constituted by a plurality of sub tanks that are in communication with the ejection outlet in parallel, and can contain the liquid to be supplied to the ejection outlet;

main tanks that are provided for the respective sub tank sets, each of the main tanks being in communication with the plurality of sub tanks that constitute the sub tank set in parallel, and containing liquid to be supplied to the sub tanks; and a control unit that controls the operations of the liquid ejection system, and switches the sub tanks in each of the sub tank sets between one supply-side sub tank that can supply liquid to the ejection outlet and the other refill-side sub tank that can be refilled with liquid from the main tank, wherein the control unit, when a first condition in which a minimum value of a suppliable time that is a time it takes for an amount of liquid contained in each supply-side sub tank to reach an amount corresponding to a switching preparation time necessary for switching between the refill-side sub tank and the supply-side sub tank is less than or equal to a maximum value of a full refill refilling time that is a period from when refill processing for performing refilling of the liquid from the main tank is started in each of the plurality of refill-side sub tanks until a state is achieved in which the refill-side sub tank is fully re-filled with liquid and can supply the liquid is satisfied, performs the refill processing on the plurality of refill-side sub tanks.

2. The liquid ejection system according to claim 1, wherein the control unit executes the refill processing until either of a condition in which all the refill-side sub tanks are each fully refilled with the liquid and a condition in which at least one of the plurality of main tanks has entered an empty state with respect to the liquid remaining amount and the refill-side sub tank that is refilled with the liquid from a main tank other than the main tank that has entered the empty state is fully refilled with the liquid is satisfied.

3. The liquid ejection system according to claim 1, wherein the control unit, in a case where a second condition in which a minimum value of the suppliable time of each of the plurality of supply-side sub tanks is greater than or equal to a maximum refilling time that is a time it takes for the fully refilled refill-side sub tank that has entered an empty state with respect to liquid to enter a state of being filled again with the liquid and being able to supply the liquid, in either of a first case that is a state immediately after switching between the supply-side sub tank and the refill-side sub tank is performed and a second case in which, in the refill-side sub tank and the main tank for containing the same type of liquid, the liquid consumed amount when the refill-side sub tank functioned as the supply-side sub tank is greater than or equal to the liquid remaining amount in the main tank, executes refill processing for performing refilling of the liquid from the main tank regardless of whether or not the first condition is satisfied.

4. The liquid ejection system according to claim 3, wherein the control unit, in a case where the second condition is satisfied and the refill processing is executed in the second case, executes preparation urging processing for prompting the preparation of a new main tank, before the refill processing is executed, or while the refill processing is being executed, in order to replace the main tank corresponding to the second case with the new main tank.

5. The liquid ejection system according to claim 1, wherein the control unit does not determine whether or not the first condition is satisfied in a period during which the refill processing is executed.

6. The liquid ejection system according to claim 1, wherein the control unit, when at least one main tank among the plurality of main tanks enters an empty state with respect to the liquid remaining amount in a period during which the refill processing is executed, executes the replacement urging processing for prompting a user to replace the main tank that has entered an empty state with a new main tank after the refill processing ends.

* * * * *